US006075482A

United States Patent [19]

Fukushima

[11] Patent Number: 6,075,482

[45] **Date of Patent: *Jun. 13, 2000**

[54] ANTENNA CONTROLLER

[75] Inventor: Tomoaki Fukushima, Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,190

[22] Filed: Oct. 6, 1997

[30] Foreign Application Priority Data

May 9, 1997 [JP] Japan ..... 9-119315

[51] Int. Cl.[7] ..... H01Q 3/00

[52] U.S. Cl. ..... 342/359

[58] Field of Search ..... 342/359

[56] References Cited

U.S. PATENT DOCUMENTS 5,166,693 11/1992 Nishikawa et al. ..... 342/422
5,227,806 7/1993 Eguchi ..... 342/359
5,537,122 7/1996 Eguchi ..... 342/359
5,594,460 1/1997 Eguchi ..... 342/359

FOREIGN PATENT DOCUMENTS 7249920 9/1995 Japan .

*Primary Examiner*—Theodore M. Blum
*Attorney, Agent, or Firm*—Rothwell, Figg, Ernst & Kurz

[57] ABSTRACT

An antenna controller mounted on a movable body is provided for controlling antenna driving for satellite tracking. The antenna controller comprises a step tracking circuit for performing step tracking operation on a turning face of the movable body while receiving electromagnetic waves from a satellite, and for calculating an antenna pointing direction in which an intensity of the electric wave is strongest. An antenna driving circuit drives the antenna in the antenna pointing direction, while a reference output correcting circuit adds a correction quantity to a reference output of a rate sensor based on a result of the step tracking operation.

8 Claims, 12 Drawing Sheets

ANTENNA CONTROLLER

BACKGROUND OF THE INVENTION

1. Field of the Invention

The present invention relates to an antenna controller mounted on a movable body for controlling an antenna drive for driving a satellite tracking antenna.

2. Description of the Related Art

FIGS. 10 and 11 are block diagrams showing two examples of current structures in which a rate sensor is used for an antenna controller mounted on a movable body for satellite tracking. The rate sensors are attached to the movable body and are used to detect a turning angular velocity of the movable body. FIG. 12 is a characteristic chart showing characteristics of a rate sensor. By using the rate sensor, an output V is obtained for a turning angular velocity ω. A detected angular velocity $\omega_1$ can be expressed by the following equation (1):

$$\omega_1 = G \times (V - V_0) \quad (1)$$

wherein $\omega_1$ represents a detected angular velocity, G represents a factor, V represents an output of the rate sensor, and $V_0$ represents an output in a stationary state (0°/S) (hereinafter referred to as a "reference output").

In FIGS. 10 and 11, the numeral 1 denotes an A/D converter for digitally converting an analog output voltage of the rate sensor, the numeral 2 denotes a lowpass filter for artificially calculating the output $V_0$ of the rate sensor during stopping, the numeral 3 denotes a factor multiplier for converting a voltage $(V-V_0)$ to an angular velocity ω, by multiplying $(V-V_0)$ by a factor of G, the numeral 4 denotes an integrator for calculating a turning angle θ from the detected angular velocity $\omega_1$ converted by the factor multiplier 3, the numeral 5 denotes an antenna direction counter for detecting an angle at which the antenna is driven, the numeral 6 denotes a step tracking circuit for outputting a signal for moving the antenna right and left or back and forth in predetermined increments or steps and for detecting a direction of the antenna in which an electric wave sent from the satellite is intensified, and the numeral 7 denotes an antenna driving circuit for driving the antenna to decrease antenna direction errors.

In FIG. 10, the reference output $V_0$ is artificially calculated by the lowpass filter 2 on the basis of the output V of the rate sensor which is digitally converted by the A/D converter 1. The factor multiplier 3 then multiplies $(V-V_0)$ by the factor G so that its output corresponds to the detected angular velocity $\omega_1$ of the movable body. The detected angular velocity $\omega_1$ is integrated by the integrator 4 so that the output of the integrator 4 corresponds to the turning angle θ of the movable body. An antenna direction error $\theta_{err}$ is calculated on the basis of the turning angle θ, antenna direction information of the antenna direction counter 5, and a step width of the step tracking circuit 6. Thus, the antenna is driven such that the antenna direction error $\theta_{err}$ is reduced by the antenna driving circuit 7. Consequently, the antenna controller corrects the antenna direction with the turning angle θ and the antenna is continuously turned in a constant direction with respect to the ground. This enables satellite tracking.

FIG. 11 is the same as FIG. 10 except that the output $V_0$ of the rate sensor in the stationary state is previously determined as a fixed value without use of a lowpass filter 2.

In the antenna controllers described above, tracking errors are common due to sensitivity errors of the rate sensor, installation angle errors of the rate sensor, differences in the artificial reference output obtained by the lowpass filter or a drift of the reference output, rolling caused when turning the movable body, and the like. Tracking error is alleviated by the step tracking circuit 6 which performs a closed loop control method using a received signal level, thereby enabling satellite tracking.

In a rate sensor that calculates turning angular velocity by subtracting the reference output $V_0$ in the stationary state from the output V and then multiplying the resulting figure by the factor G, if the antenna controller calculates the reference output and then the output in the stationary state drifts, a difference will exist between the reference output recognized by the antenna controller and the true reference output which has drifted. For this reason, the calculated turning angular velocity includes greater errors. Consequently, when using an open loop control method for controlling the antenna with information on the turning angular velocity, tracking error actually increases over time until a satellite can no longer be tracked.

In order to decrease tracking error, the following method has been used. More specifically, an AC component is removed from the output of the rate sensor through a lowpass filter and the value thus obtained is artificially set to the reference output such that the reference output is frequently updated and drift is removed. However, when the movable body meanders or turns, difference between the artificially obtained reference output and the true reference output is increased. Under these conditions tracking error cannot be lessened.

A further method for decreasing the tracking errors is used by the step tracking circuit 6 which performs closed loop control method or the like. According to this method, if stability and band of a closed loop are restricted with respect to performance of a receiver or an antenna, an increase rate of the tracking errors caused by the drift of the reference output is sometimes greater than a decrease rate of the tracking error obtained by the closed loop control method. For this reason, this method is not practical for lessening tracking error.

For the above-mentioned reasons, the stability of the reference output of the rate sensor used for the open loop control method is important to the antenna controller according to the prior art. Therefore, the rate sensor whose reference output greatly fluctuates is difficult to use with a satellite tracking antenna controller mounted on a movable body. For this reason, rate sensors whose reference outputs do not fluctuate should be selected through stringent testing, or an optical fiber gyro or a like instrument with a stable reference output should be used. This raises the cost of the antenna controller.

SUMMARY OF THE INVENTION

In order to solve the above-mentioned problems, it is an object of the present invention to provide an antenna controller mounted on a movable body for controlling antenna driving to track a satellite in which an inexpensive rate sensor whose reference output greatly fluctuates can be used for the antenna controller by utilizing results of step tracking operation to update the reference output of the rate sensor.

The present invention provides an antenna controller for multiplying a difference between an output of a rate sensor mounted on a movable body and a reference output by a predetermined factor to detect a turning angular velocity of a movable body, and for always turning an antenna to a direction of a satellite on the basis of information on the turning angular velocity, comprising a step tracking circuit for performing step tracking operation on a turning face of the movable body while receiving an electric wave sent from the satellite, and for calculating an antenna direction in which an intensity of electromagnetic radiation is increased, an antenna driving circuit for driving the antenna in the direction calculated by the step tracking circuit, and a reference output correcting circuit for correcting the reference output on the basis of the antenna direction calculated by the step tracking circuit.

Preferably, the antenna controller further comprises a correction quantity adjusting circuit for changing a quantity of correction for the reference output which is performed by the reference output correcting circuit on the basis of a time taken after a rate sensor is turned on.

It is preferable that the antenna controller should further comprise a correction quantity adjusting circuit for changing a quantity of correction for the reference output which is performed by the reference output correcting circuit if the output of the rate sensor has a constant value or less for a constant time.

Preferably, the antenna controller further comprises a step tracking function stopping circuit for stopping operation of the step tracking circuit depending on a change quantity of a received signal level of the electric wave sent from the satellite.

It is preferable that the antenna controller should further comprise a straight running detecting circuit for detecting that the movable body is kept in a stopped state or a straight running state on the basis of the output of the rate sensor.

Preferably, the straight running detecting circuit detects that the movable body is kept in the stopped state or the straight running state on the basis of a difference between the outputs of the rate sensor which are sent to two lowpass filters having different cut-off frequency characteristics.

It is preferable that the straight running detecting circuit should detect that the movable body is kept in the stopped state or the straight running state on the basis of a received signal level of the electric wave sent from the satellite.

Preferably, the step tracking circuit stops operation thereof on the basis of an intensity of a received signal level of the electric wave sent from the satellite when the straight running detecting circuit detects that the movable body is kept in the stopped state or the straight running state.

Because the present invention has the above-mentioned structure, the following effects can be obtained.

In the systems described above, if the antenna controller calculates a reference output and then the output in the stationary state drifts, a difference is created between the reference output recognized by the antenna controller and the true reference output which has drifted. As a result, error in the calculated turning angular velocity is increased. When performing open loop control on the antenna by using the information on the turning angular velocity, tracking errors are increased with the passage of time so that the satellite cannot be tracked in some cases. According to the present invention, the correction quantity based on the result of the step tracking operation is added to the reference output of the rate sensor. Therefore, it is possible to reduce the difference between the reference output recognized by the antenna controller and the true reference output which has drifted.

Conventionally, there has been a technique for decreasing tracking errors by sending an output of a rate sensor to a lowpass filter and removing an AC component to artificially obtain a value as a reference output. In this technique, a difference between the artificially obtained reference output and a true reference output is increased while a movable body meanders or turns. Therefore, the tracking errors cannot be decreased in some cases. According to the present invention, the difference between the reference output recognized by the antenna controller and the true reference output which has drifted can be reduced irrespective of the running state of the movable body.

If stability and band of closed loop control are restricted with respect to performance of a receiver or an antenna, an increase in tracking error caused by the drift of the reference output is sometimes greater than the decrease made possible by the closed loop control. Therefore, the tracking errors cannot be decreased. According to the present invention, the reference output is directly corrected before the drift of the reference output is integrated. A satellite can thereby be tracked with high reliability by using the antenna controller having closed loop control with a restricted stability and loop bandwidth.

According to the present invention, furthermore, a rate sensor whose reference output greatly drifts can be used for the antenna controller mounted on a movable body. Therefore, an inexpensive rate sensor, such as a piezoelectric vibration gyro, can be employed for the antenna controller, allowing the cost of the antenna controller to be reduced.

DESCRIPTION OF PREFERRED EMBODIMENTS

First Embodiment

Figure 1:
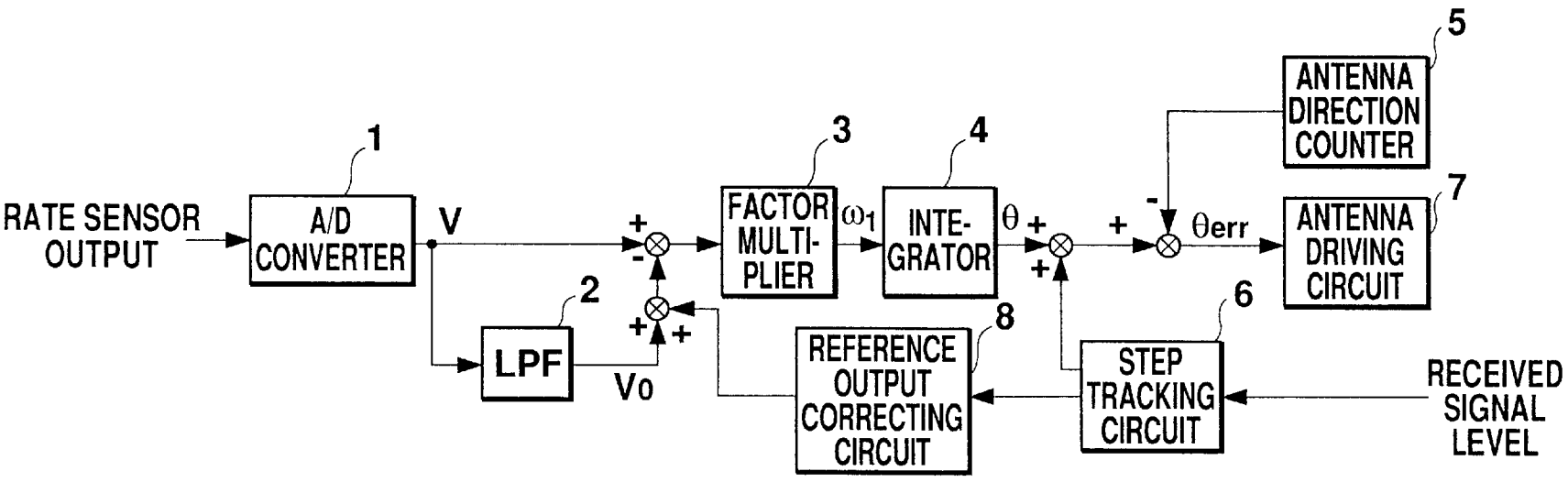
FIG. 1 is a block diagram showing an antenna controller according to a first embodiment of the present invention.

FIG. 1 is a block diagram showing an antenna controller according to a first embodiment of the present invention. In FIG. 1, the numeral 1 denotes an A/D converter for digitally converting an analog output voltage of a rate sensor, the numeral 2 denotes a lowpass filter for artificially calculating an output $V_0$ of the rate sensor during stopping, the numeral 3 denotes a factor multiplier for converting a voltage to an angular velocity, the numeral 4 denotes an integrator for calculating a turning angle θ from a detected angular velocity $\omega_1$ converted by the factor multiplier 3, the numeral 5 denotes an antenna direction counter for detecting an angle at which an antenna is driven, the numeral 6 denotes a step tracking circuit for detecting a direction in which an electric wave sent from a satellite is intensified, the numeral 7 denotes an antenna driving circuit for driving the antenna to decrease antenna direction error, and the numeral 8 denotes a reference output correcting circuit for adding a correction quantity to a reference output on the basis of a result obtained by the step tracking circuit 6.

Figure 2:
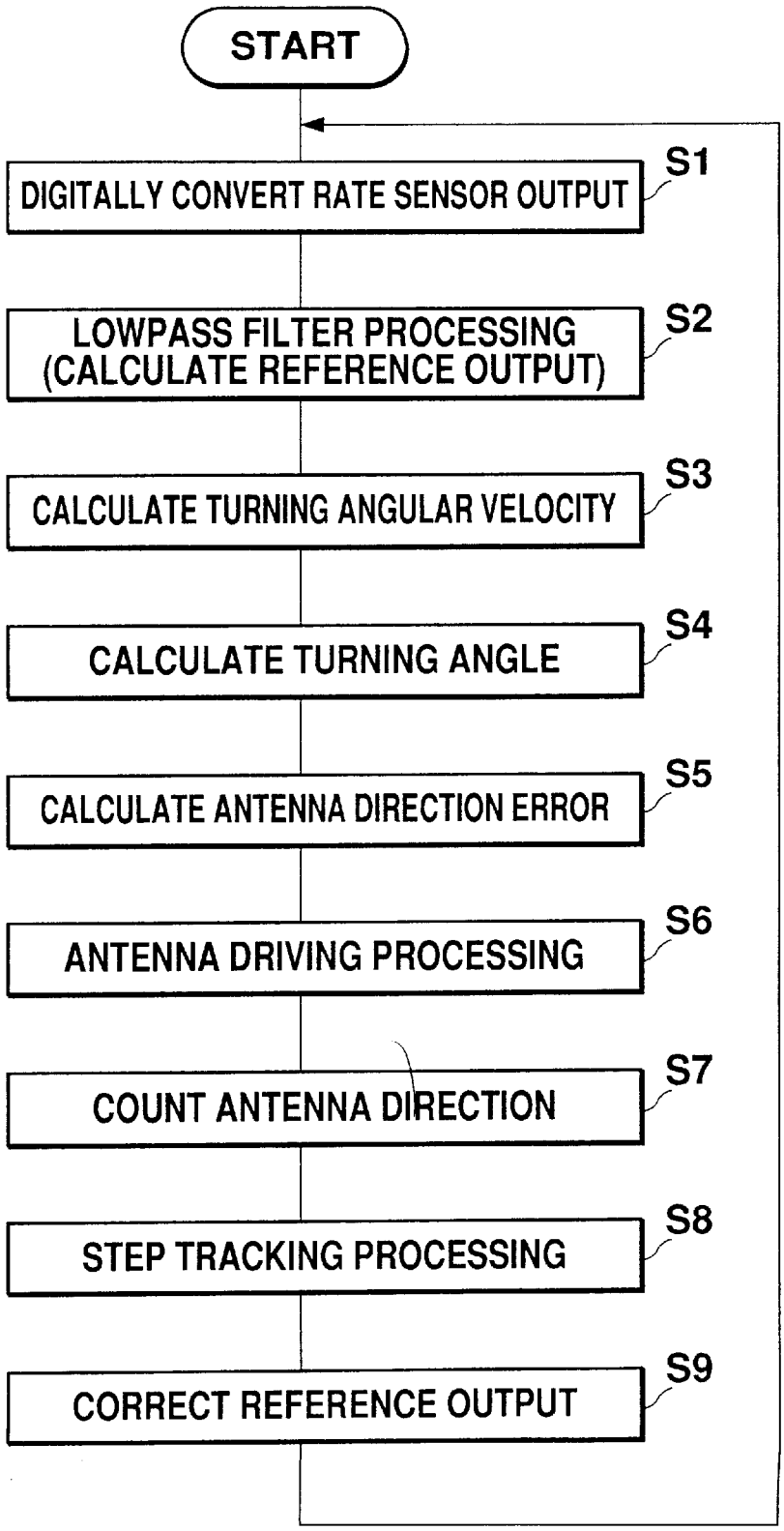
FIG. 2 is a flow chart showing an operation flow of the antenna controller according to the present invention.

FIG. 2 is a flow chart of the antenna controller according to the operation of the present invention. The operation flow will be described below with reference to FIG. 2. An output V of the rate sensor which is digitally converted by the A/D converter 1 is processed by the lowpass filter 2 so that a reference output $V_0$ is calculated (Steps S1 and S2). A correction quantity calculated in a last computing loop by the reference output correcting circuit 8 as will be described below is added to an output of the lowpass filter 2. The factor multiplier 3 multiplies $(V-V_0)$ by a factor G so that its output corresponds to a detected angular velocity $\omega_1$ of a movable body (Step S3). The detected angular velocity $\omega_1$ is integrated by the integrator 4 so that its output corresponds to a turning angle θ of the movable body (Step S4). An antenna direction error $\theta_{err}$ is calculated on the basis of calculated turning angle θ, antenna direction information from the antenna direction counter 5, and a step width from the step tracking circuit 6 (Step S5). The antenna is driven by the antenna driving circuit 7 in such a manner that the antenna direction error $\theta_{err}$ is reduced (step S6). An angle at which the antenna is painted is calculated by the antenna direction counter 5 to provide for a next computing loop (Step S7). The step tracking circuit 6 calculates a direction in which a stronger electric wave is obtained, that is, a clockwise or counterclockwise direction in which stepping is performed or a central direction in which the stepping is not performed (Step S8). The reference output correcting circuit 8 determines the correction quantity for the reference output on the basis of a result obtained by the step tracking circuit 6, and adds the correction quantity to the output $V_0$ of the lowpass filter 2 at the next computing loop (Step S9). The operation flow of the antenna controller according to the present invention is thus completed and the routine returns to Step S1.

Execution of a computing loop requires about 50 milliseconds. In every computing loop, digital conversion is performed by the A/D converter 1 (Step S1) and the reference output $V_0$ is calculated by the lowpass filter 2 (Step S2). The correction quantity is added to reference output $V_0$ by the reference output correcting circuit 8 in every computing loop. A correction value is updated at a first computing loop after step tracking operation is completed once. In each computing loop, the detected angular velocity $\omega_1$ is calculated by the factor multiplier 3 (Step S3), the turning angle θ is calculated by the integrator 4 (Step S4), the antenna direction error $\theta_{err}$ is calculated (Step S5), the antenna is driven by the antenna driving circuit 7 (Step S6), and the antenna direction is calculated (Step S7). In some computing loops, the step tracking circuit 6 compares the intensity of a received signal level according to a step timing thereof. The first direction of the antenna is fixed for 8 seconds so as to have any elevation with respect to the ground.

The step tracking circuit 6 will be described below in detail. The step tracking circuit 6 functions to perform the following step tracking operation. The initial antenna pointing direction will hereinafter be referred to as a "central direction". 8 seconds are equivalent to 160 computing loops. Therefore, timing is calculated by counting the number of computing loops. For the first 4 seconds (equivalent to 80 computing loops), the received signal level of the satellite obtained from a receiver is not integrated in order to wait for stabilization. For the next 4 seconds, the received signal level is integrated to calculate an average value.

Next, an angle of −10 degrees is forcedly added to the antenna direction error in order to rotate the antenna by 10 degrees clockwise as viewed from above. At the same time, the antenna driving speed is increased by 20 deg/s to cause the antenna direction to converge more quickly. This direction will hereinafter be referred to as a "right direction". After the antenna direction converges, it is fixed for 8 seconds in that direction in the same manner as the 8 seconds in the initial direction. Similarly, the received signal level is integrated for 4 seconds after 4 seconds have first passed. Thus, an average value is calculated.

Thereafter, an angle of +20 degrees is forcedly added to the antenna direction error in order to rotate the antenna by 20 degrees counterclockwise as viewed from above. At the same time, the antenna driving speed is increased by 20 deg/s to cause the antenna direction to converge more quickly. This direction will be hereinafter referred to as a "left direction". After the antenna direction converges, it is fixed for 8 seconds in that direction in the same manner as in the initial direction. Similarly, the received signal level is integrated for 4 seconds after 4 seconds have first passed. An average value is thereby calculated.

As described above, the average values of the received signal levels are obtained in three directions, that is, the respective central, right, and left directions and the direction having the greatest average value is determined. The direction obtained by the calculation is a result of the step tracking operation. At this time, the antenna is turned to the direction having the greatest average received signal value as a result of the step tracking operation to start the next step tracking operation in which the then current antenna pointing direction is set to the central direction.

More specifically, the antenna direction error is adjusted in accordance with the result of the step tracking operation in the following manner. If a value in the right direction is the greatest, an angle of −20 degrees is forcedly added to the antenna direction error at a next computing loop in order to set the right direction as the central direction during the next step tracking operation. At the same time, the antenna driving speed is increased by 20 deg/s to cause the antenna to converge more quickly. If a value in the central direction is the greatest, an angle of −10 degrees is forcedly added to the antenna direction error at a next computing loop in order to start the next step tracking operation in the central direction. At the same time, the antenna driving speed is increased by 20 deg/s to cause the antenna direction to converge more quickly. If a value in the left direction is the greatest, nothing is added to the antenna direction error at the next computing loop. Thus, one step tracking operation is completed.

The average values of the received signal levels in the three directions, that is, the central, right and left directions are compared with one another in the following manner. If all three values are equal to one another, it is supposed that the received signal level in the central direction is the highest. If the values in the central and right directions are equal to each other and the value in the left direction is lower, it is supposed that the received signal level in the right direction is the highest. The step tracking circuit 6 operates as described above in detail.

The reference output correcting circuit 8 will be described below in detail. The rate sensor according to the present embodiment is a piezo-electric vibration gyro having a turning detectivity of 45 deg/s/V(=G). A correction quantity has a minimum unit of 1 mV which is equivalent to 0.045 deg/s(=G×0.001). A time taken to perform the step tracking operation once has a maximum value of 26.5 seconds (=8 seconds+10 degrees/20 deg/s+8 seconds+20 degrees/20 deg/s+8 seconds+20 degrees/20 deg/5: the result of the step tracking operation is the right direction). The correction quantity is added to the reference output approximately every 26.5 seconds. The reference output correcting circuit 8 determines the correction quantity according to the result of the step tracking operation. If the result of the step tracking operation is the right direction, the reference output correcting circuit 8 increases the correction quantity by 3 mV and adds the increased correction quantity to the reference output. If the result of the step tracking operation is the left direction, the reference output correcting circuit 8 decreases the correction quantity by 3 mV and adds the decreased correction quantity to the reference output. If the result of the step tracking operation is the central direction, the reference output correcting circuit 8 does not update the correction quantity, but adds a last correction quantity to the reference output. The correction quantity of ±3 mV is equivalent to ±0.135 deg/s(=G×±0.003). In this case, the correction quantity is divided by a time taken to perform the step tracking operation once so that a value of ±0.005 deg/s/s(=±0.135 deg/s/26.5 seconds) is obtained. Consequently, even if the reference output of the rate sensor drifts at a rate of ±0.005 deg/s/s, correction can theoretically be performed. In actuality, the correction can be performed depending on a success rate of the step tracking operation. Therefore, it is preferable that an updated value of the correction quantity obtained every time the step tracking operation is completed once should be adjusted by field tests. The reference output correcting circuit 8 operates as described above in detail.

Second Embodiment

Figure 3:
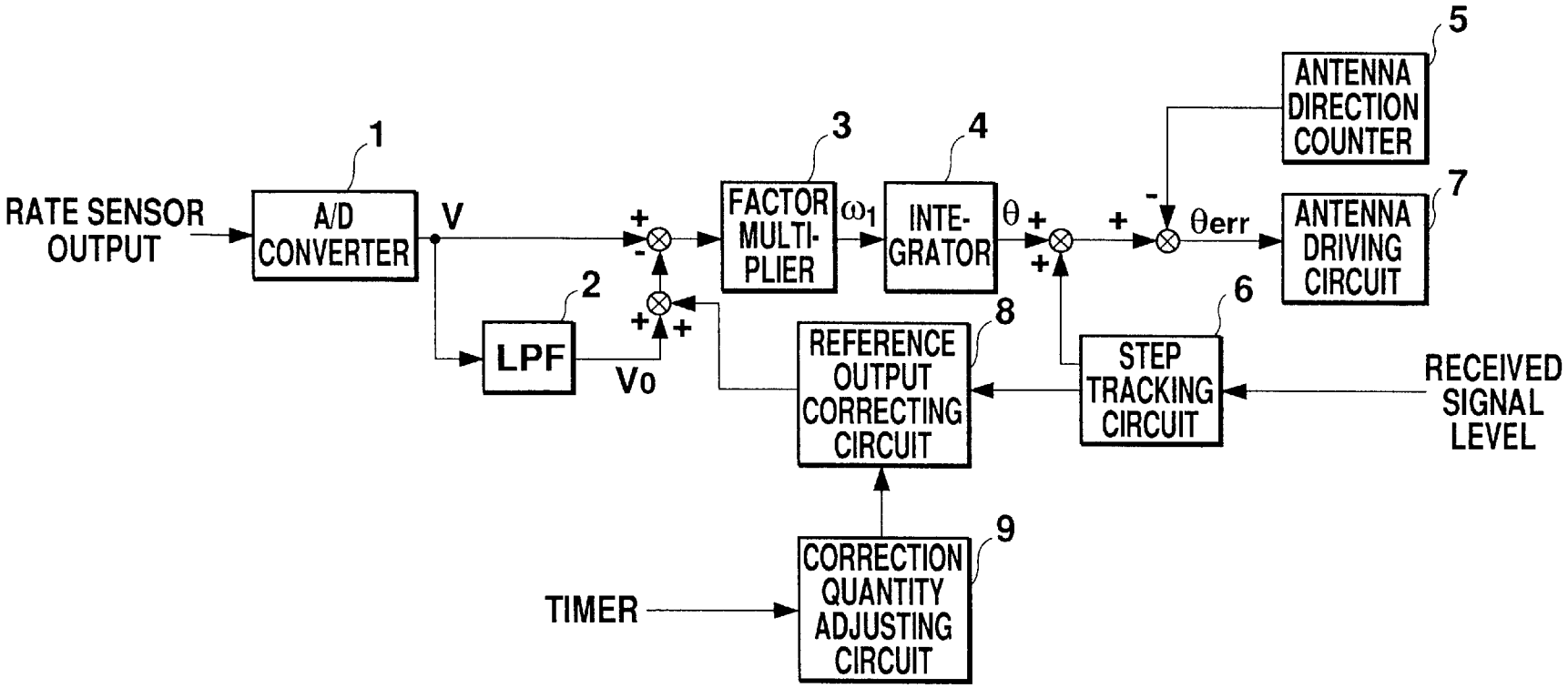
FIG. 3 is a block diagram showing a second embodiment of the present invention.

FIG. 3 is a block diagram showing an antenna controller according to a second embodiment of the present invention. In FIG. 3, parts corresponding to those in FIG. 1 are given the same number and their explanation will not be repeated. The numeral 9 denotes a correction quantity adjusting circuit for counting, by means of a timer or the like, a time taken after a rate sensor is turned on. This circuit causes a correction quantity to change after a predetermined time has passed.

Characteristics of the rate sensor to be used are first measured to acquire a relationship between the passage of time and a drift quantity of an output in a stationary state. In this case, a fluctuation rate of the drift quantity of the rate sensor is set to a value of ±0.00225 deg/s/s after 30 minutes have passed since the rate sensor was turned on. Accordingly, the correction quantity adjusting circuit 9 reduces the correction quantity to 2 mV. When the correction quantity is 2 mV, ±0.090 deg/s(=G×±0.002), which is equivalent to 2 mV, is divided by the time taken to perform one step tracking operation. Consequently, a value of ±0.0034 deg/s/s(=±0.090 deg/s/26.5 seconds) is obtained as a fluctuation rate of a drift quantity which can be corrected.

The correction quantity adjusting circuit 9 detects, by means of a timer or by counting the number of computing loops, that 30 minutes have passed since the rate sensor was turned on, and changes an update unit of the correction quantity from ±3 mV to ±2 mV.

Third Embodiment

Figure 4:
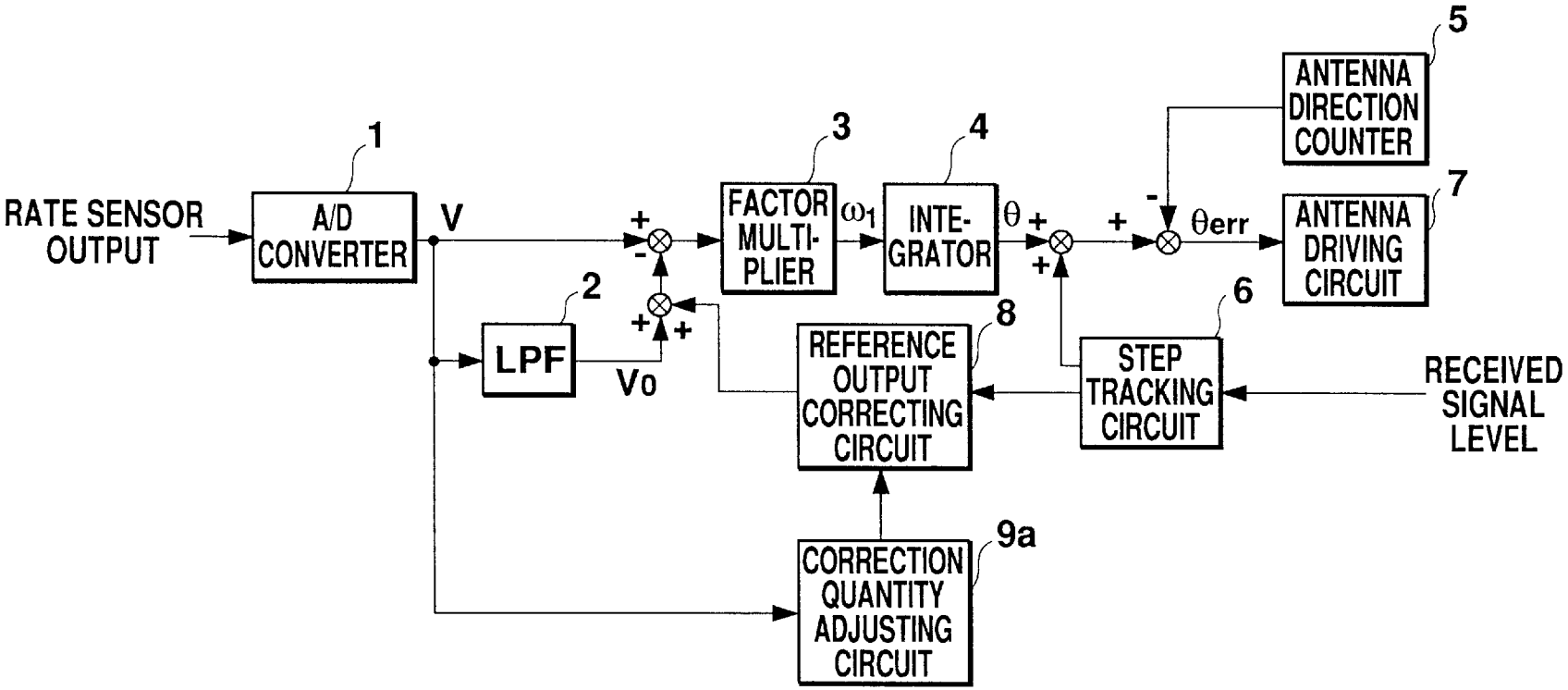
FIG. 4 is a block diagram showing a third embodiment of the present invention.

FIG. 4 is a block diagram showing an antenna controller according to a third embodiment of the present invention. In FIG. 4, parts corresponding to those in FIG. 1 are given the same number and explanation will not be repeated. The numeral 9*a* denotes a correction quantity adjusting circuit for changing a correction quantity if an output of a rate sensor is equal to or less then a certain value or less for a certain time.

Characteristics of the rate sensor to be used are first measured and a relationship between the passage of time and a drift quantity of an output in a stationary state is acquired in the same manner as in the second embodiment. In this case, a fluctuation rate of the drift quantity of the rate sensor is set to ±0.00225 deg/s/s after 30 minutes have passed since the rate sensor was turned on. Accordingly, when the fluctuation rate of the drift quantity of the rate sensor is set equal to or less than ±0.00225 deg/s/s, the correction quantity adjusting circuit 9*a* changes an update unit of the correction quantity from ±3 mV to ±2 mV. For simplicity, the correction quantity adjusting circuit 9*a* averages the output of the rate sensor for 26.5 seconds taken for one cycle of step tracking operation. Then, the correction quantity adjusting circuit 9*a* averages the output of the rate sensor for 26.5 seconds again. These two average values are compared with each other. If a difference between the two values is 2 mV or less, the update unit of the correction quantity is changed from ±3 mV to ±2 mV.

Fourth Embodiment

Figure 5:
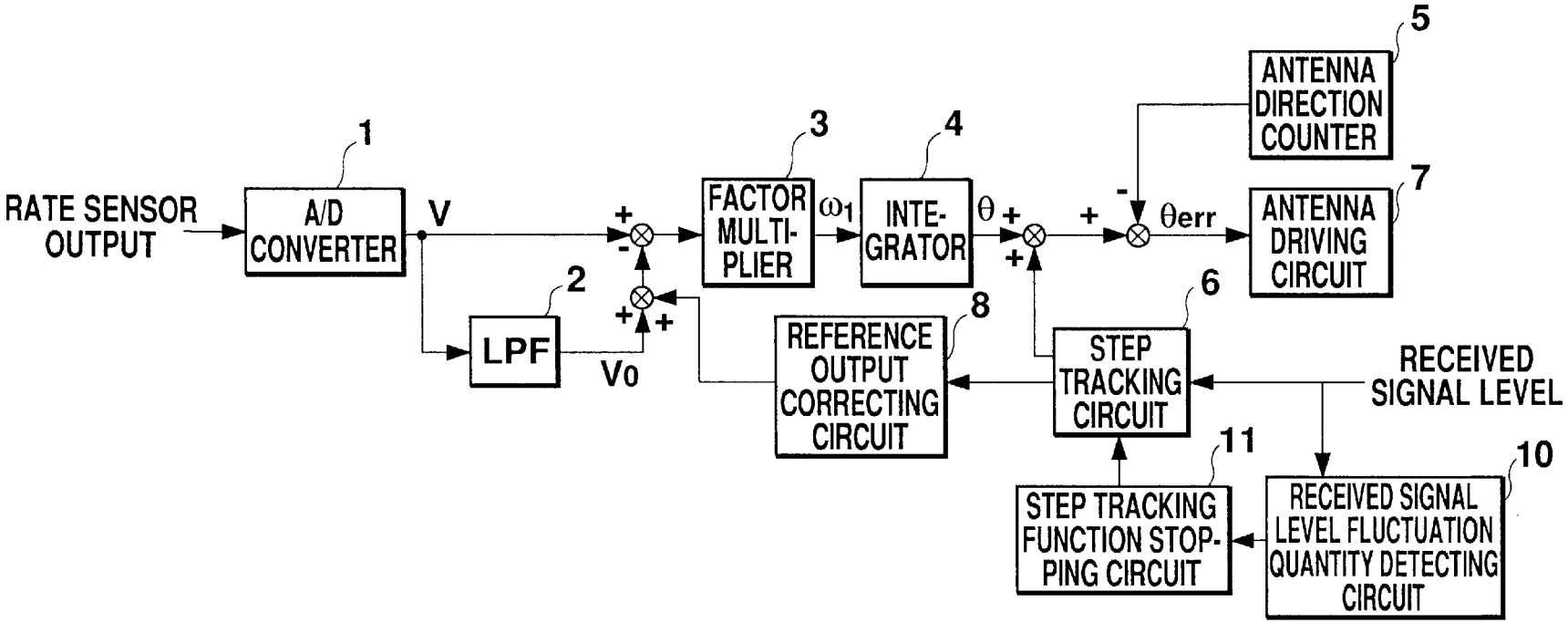
FIG. 5 is a block diagram showing a fourth embodiment of the present invention.

FIG. 5 is a block diagram showing an antenna controller according to a fourth embodiment of the present invention. In FIG. 5, parts corresponding to those in FIG. 1 are given the same number and explanation will not be repeated. The numeral 10 denotes a circuit for detecting a fluctuation quantity of a received signal level, while the numeral 11 denotes a step tracking function stopping circuit for judging that the received signal level is not reliable and stopping the function of a step tracking circuit 6 if the fluctuation quantity of the received signal level is greater than a predetermined value.

For example, the fluctuation quantity of the received signal level is represented by "dispersion" which is always calculated in a constant sample quantity. If a movable body runs on an open road having neither trees nor buildings, it is supposed that the fluctuation quantity of the received signal level is small and the dispersion is correspondingly small. If the dispersion (fluctuation quantity) of the received signal level which is obtained by calculation is greater than a specific value, the step tracking function stopping circuit 11 judges that the received signal level is not reliable, and stops the function of the step tracking circuit 6.

Fifth Embodiment

Figure 6:
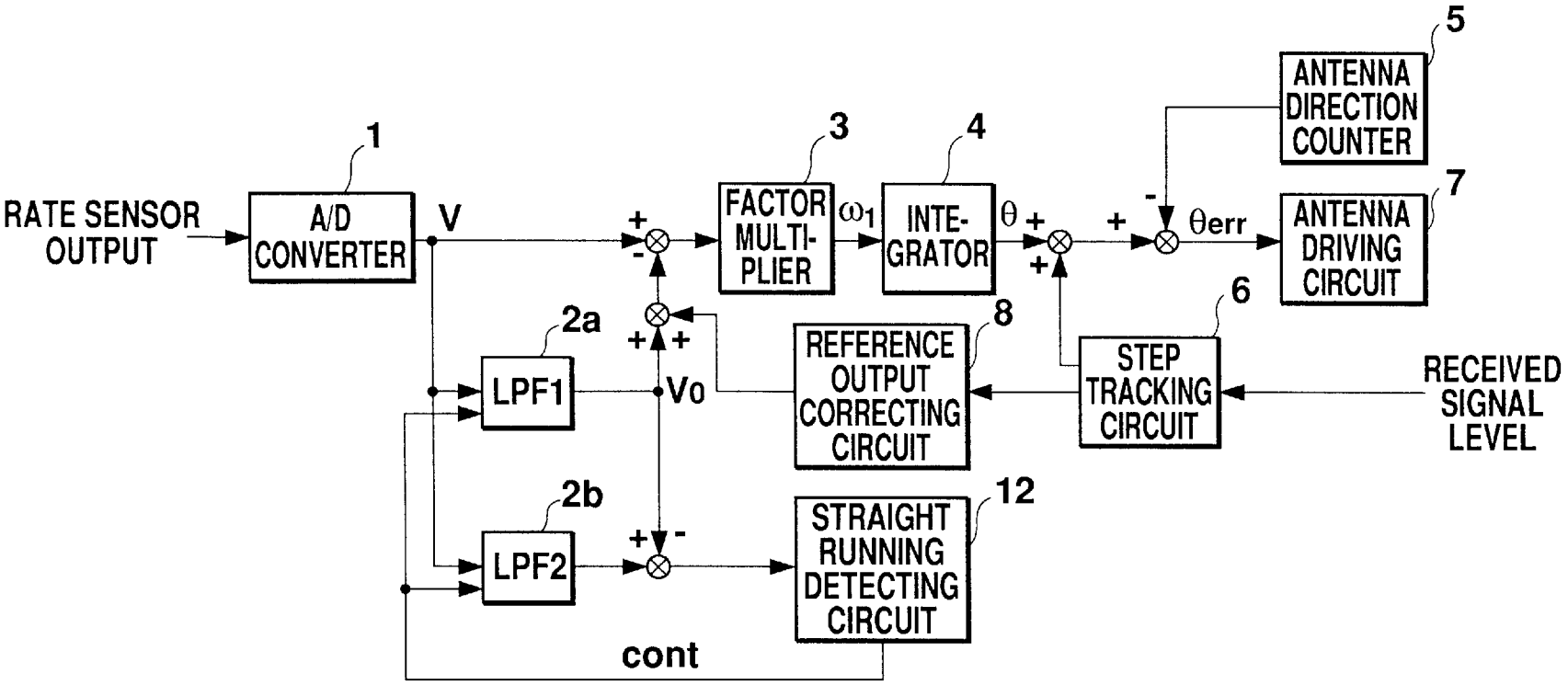
FIG. 6 is a block diagram showing a fifth embodiment of the present invention.

FIG. 6 is a block diagram showing an antenna controller according to a fifth embodiment of the present invention. In FIG. 6, parts corresponding to those in FIG. 1 are given the same number and explanation will not be repeated. The numerals 2*a* and 2*b* denote lowpass filters having different characteristics. The lowpass filter 2*a* has a lower cut-off frequency than that of the lowpass filter 2*b*. The numeral 12 denotes a straight running detecting circuit for inputting a difference between outputs of a rate sensor sent to the lowpass filters 2*a* and 2*b* and for detecting whether or not the movable body, such as a car, is running in a straight direction.

Figure 7:
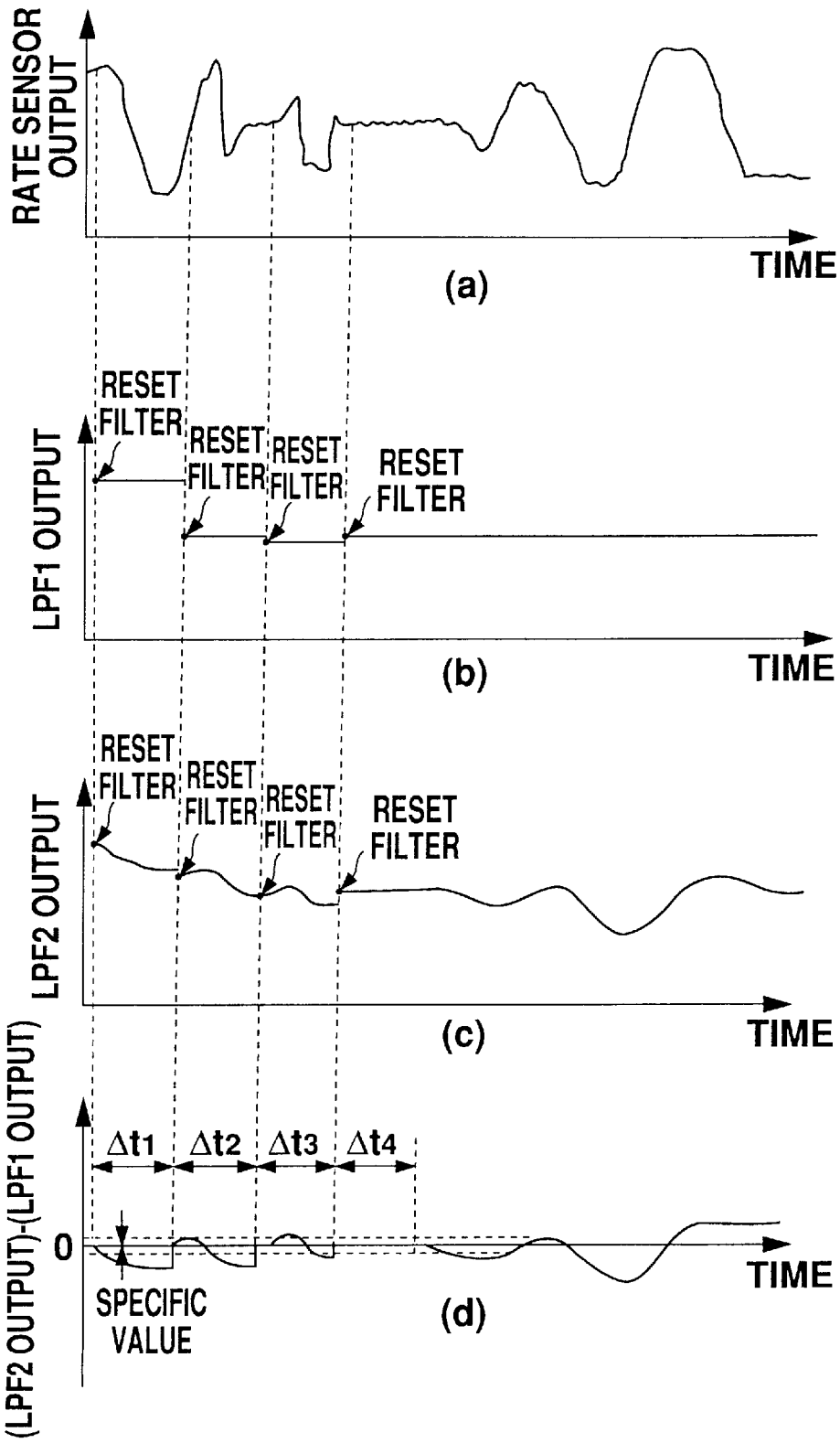
FIGS. 7(*a*), 7(*b*), 7(*c*), and 7(*d*) are charts showing a principle of straight running detection according to the fifth embodiment of the present invention.

A principle of straight running detection is shown in FIGS. 7(*a*) to 7(*d*). When the output of the rate sensor is obtained as shown in FIG. 7(*a*), an output of the lowpass filter 2*a* is obtained as shown in FIG. 7(*b*). In this case, the lowpass filter 2*a* is reset each time at timing intervals shown by broken lines. The straight running detecting circuit 12 controls the resetting operation in response to a control signal "cont". An output of the lowpass filter 2*b* is obtained as shown in FIG. 7(*c*) because the cut-off frequency thereof is higher than that of the lowpass filter 2*a*. The output of the rate sensor fluctuates corresponding to the higher cut-off frequency. A difference between the two outputs is obtained as shown in FIG. 7(*d*). The straight running detecting circuit 12 monitors an absolute value of the output difference for each time shown by Δt in FIG. 7(*d*). If the absolute value never exceeds a specific value, for example, 3 mV (which is equivalent to 0.135 deg/s), it is judged that the movable body runs straight or stops. If the absolute value exceeds 3 mV, the lowpass filters 2*a* and 2*b* are reset to filter the output of the rate sensor from the start.

In FIG. 7(*d*), all difference values deviate from the specific value at $\Delta t_1$, $\Delta t_2$, and $\Delta t_3$. Therefore, the straight running detecting circuit 12 resets the lowpass filters 2*a* and 2*b* in the timing shown by the broken lines, and performs detection again. At $\Delta t_4$, the difference value is kept within the specific value. Therefore, it is judged that the movable body runs straight or stops for $\Delta t_4$. Subsequently, the lowpass filters 2*a* and 2*b* are not reset. Precision of straight running detection depends on the following parameters, that is, Δt, the specific value, the cut-off frequency of the lowpass filter 2*a,* and the cut-off frequency of the lowpass filter 2*b*.

Sixth Embodiment

Figure 8:
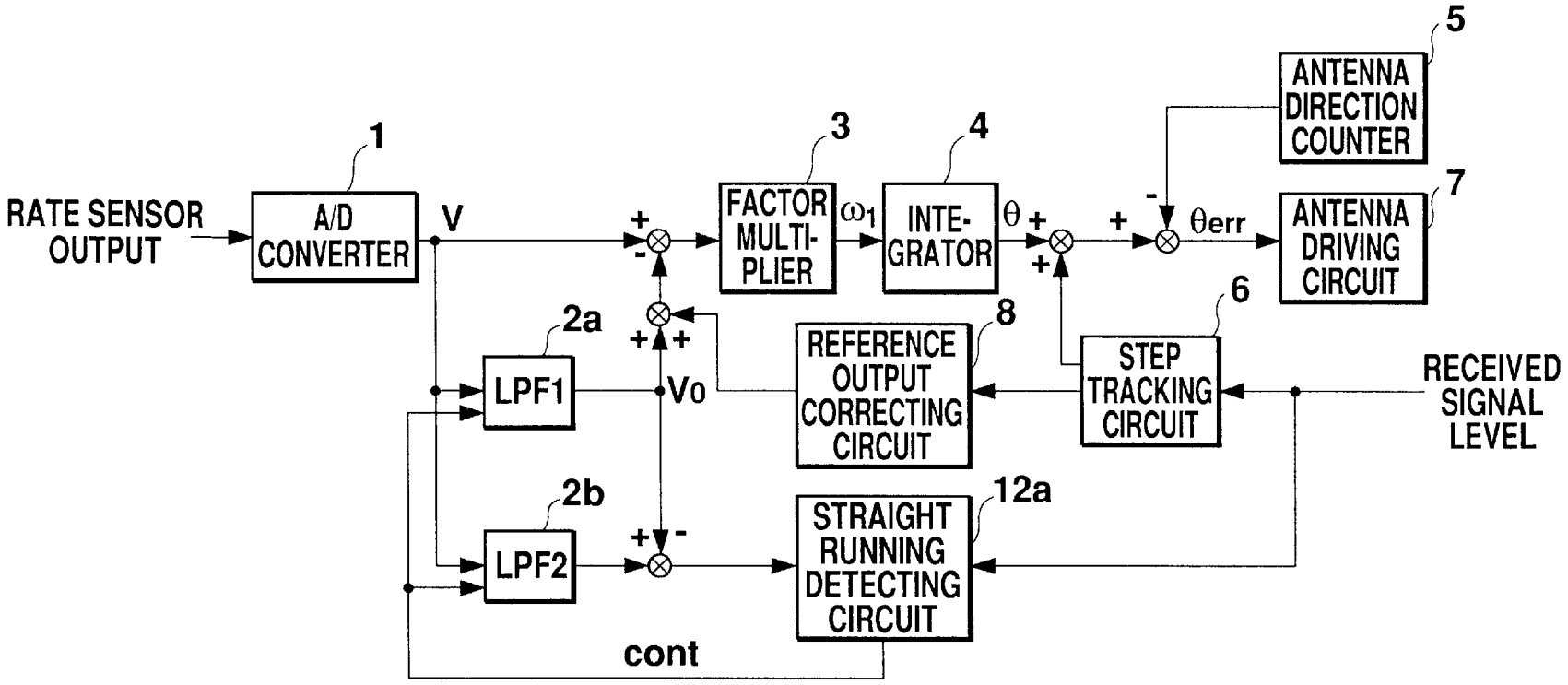
FIG. 8 is a block diagram showing a sixth embodiment of the present invention.

FIG. 8 is a block diagram showing an antenna controller according to a sixth embodiment of the present invention. In FIG. 8, parts corresponding to those in FIG. 6 are given the same number and explanation will not be repeated. The numeral 12*a* denotes a straight running detecting circuit capable of performing and stopping the same function as that of the straight running detecting circuit 12 depending on an intensity of a received signal level. The straight running detecting circuit 12*a* always monitors the intensity of the received signal level. If the received signal level is not obtained for a constant time, the straight running detecting function of the running direction of the movable body (car) is performed.

Seventh Embodiment

Figure 9:
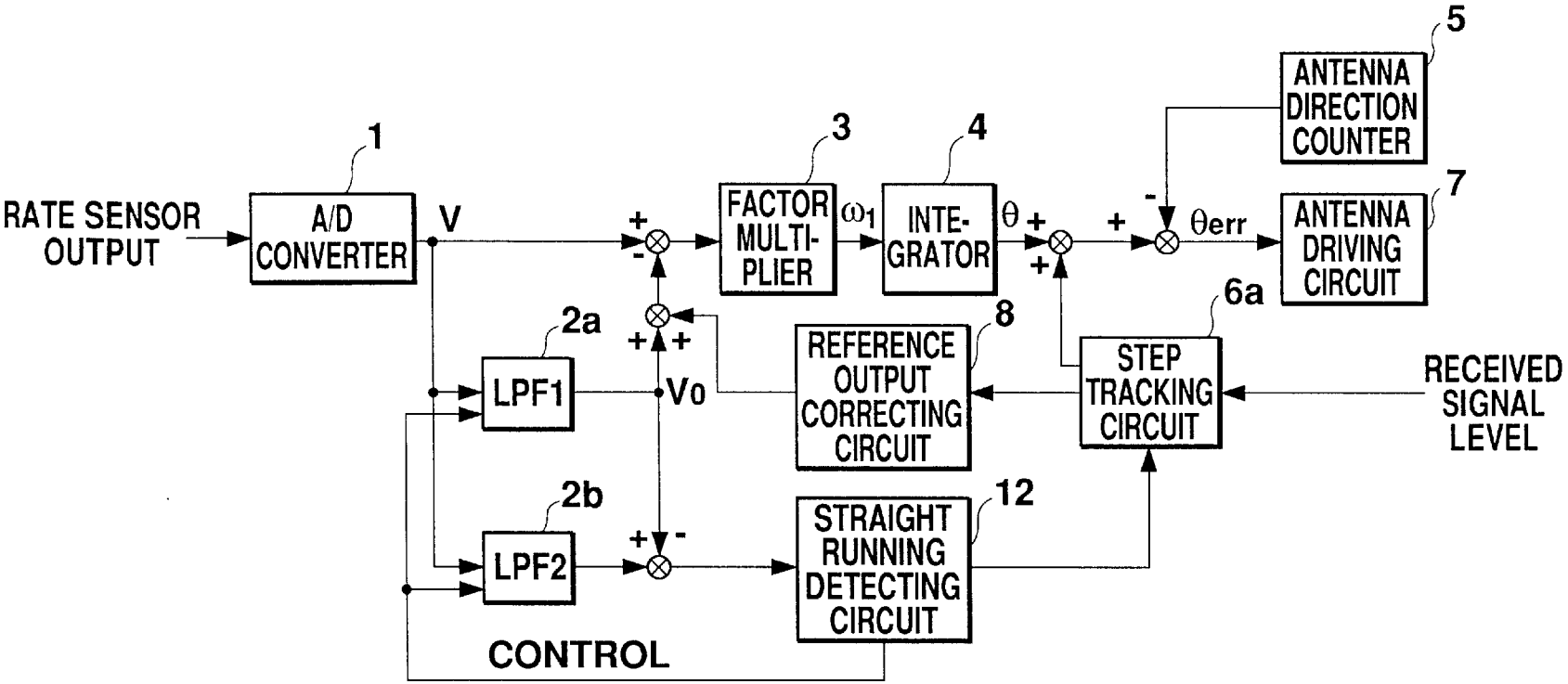
FIG. 9 is a block diagram showing a seventh embodiment of the present invention.
Figure 10:
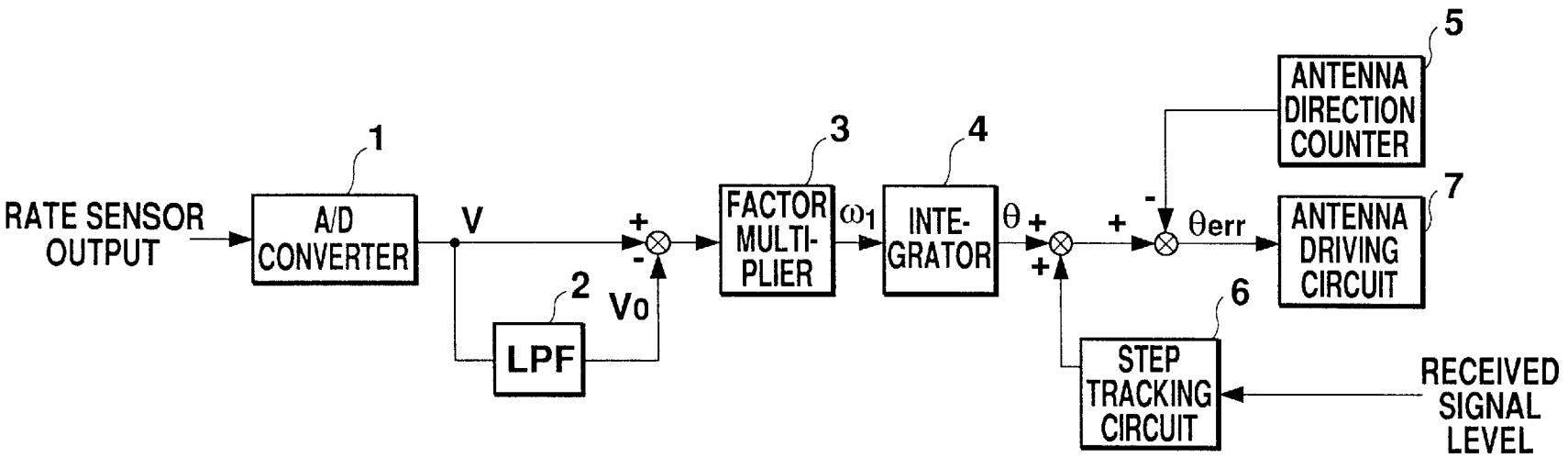
FIG. 10 is a block diagram showing an antenna controller according to the prior art.
Figure 11:
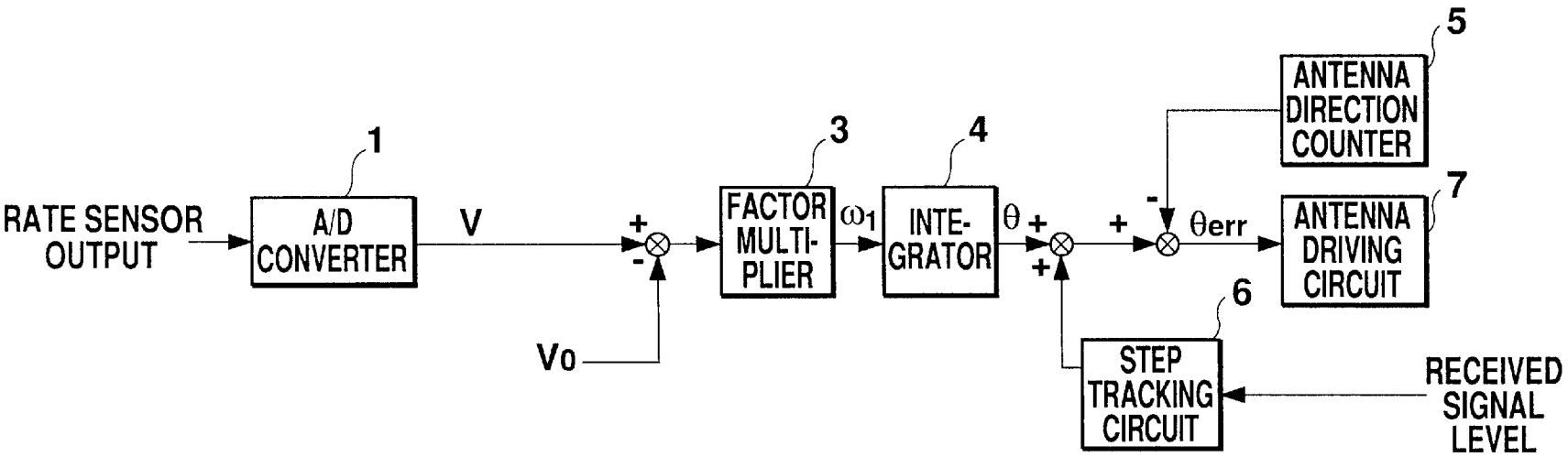
FIG. 11 is a block diagram showing another antenna controller according to the prior art.
Figure 12:
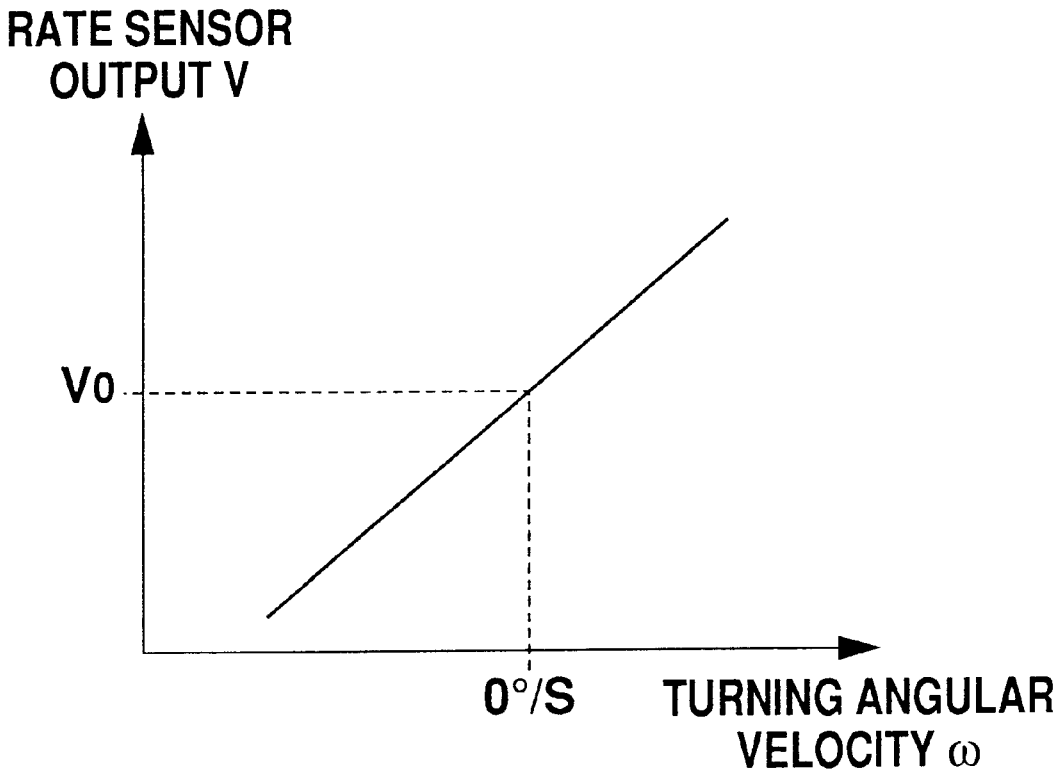
FIG. 12 is a characteristic chart showing a characteristic of a rate sensor in the antenna controller according to the prior art.

FIG. 9 is a block diagram showing an antenna controller according to a seventh embodiment of the present invention. In FIG. 9, parts corresponding to those in FIG. 6 are given the same number and explanation will not be repeated. The numeral 6*a* denotes a step tracking circuit capable of performing and stopping the same function as that of the step tracking circuit 6 on the basis of an intensity of a received signal level and information from a straight running detecting circuit 12. The step tracking circuit 6*a* fetches information on straight run or stoppage from the straight running detecting circuit 12. In that case, when a received signal level sufficient for communication is obtained, the step tracking function is stopped.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. An antenna controller for controlling the pointing direction of an antenna mounted on a movable body to point in the direction of a satellite sending electromagnetic waves to said antenna, based on a turning angle velocity of said movable body, said turning angle velocity being calculated from an output of a rate sensor mounted on said movable body and a reference output based on the output of said rate sensor, comprising:

a step tracking circuit for performing a step tracking operation with respect to the pointing direction of said antenna while receiving electromagnetic waves from the satellite, and for calculating an antenna pointing direction in which the intensity of the received electromagnetic waves is greatest;

an antenna driving circuit for driving the antenna in a direction based on the antenna pointing direction calculated by the step tracking circuit and a turning angle of said movable body determined from said turning angle velocity; and a reference output correcting circuit for correcting the reference output on the basis of the antenna pointing direction calculated by the step tracking circuit.

2. The antenna controller according to claim 1, further comprising a correction quantity adjusting circuit for changing a quantity of correction of the reference output performed by the reference output correcting circuit based on the time elapsed after the rate sensor is turned on.

3. The antenna controller according to claim 1, further comprising a correction quantity adjusting circuit for changing a quantity of correction of the reference output performed by the reference output correcting circuit when the output of the rate sensor is less than or equal to a predetermined value for a predetermined time.

4. The antenna controller according to claim 1, further comprising a step tracking function stopping circuit for stopping operation of the step tracking circuit depending on a change in quantity of a received signal level of the electromagnetic waves sent from the satellite.

5. The antenna controller according to claim 1, further comprising a straight running detecting circuit for detecting that the movable body is kept in a stopped state or a straight running state on the basis of the output of the rate sensor.

6. The antenna controller according to claim 5, wherein the straight running detecting circuit detects that the movable body is maintaining a stopped state or a straight running state on the basis of a difference between outputs of the rate sensor which are sent to two lowpass filters having different cut-off frequency characteristics.

7. The antenna controller according to claim 5, wherein the straight running detecting circuit detects that the movable body is maintaining a stopped state or a straight running state on the basis of a received signal level of the electromagnetic wave sent from the satellite.

8. The antenna controller according to claim 5, wherein the step tracking circuit suspends operation based on the value of a received signal level of electromagnetic waves sent from the satellite when the straight running detecting circuit detects that the movable body is maintaining a stopped state or a straight running state.

* * * * *